US008199939B2

(12) United States Patent
Suvanto et al.

(10) Patent No.: US 8,199,939 B2
(45) Date of Patent: Jun. 12, 2012

(54) MICROPHONE PACKAGE

(75) Inventors: Mikko Veli Aimo Suvanto, Tampere (FI); Tapio Liusvaara, Tampere (FI)

(73) Assignee: Nokia Corporation, Espoo (FI)

( * ) Notice: Subject to any disclaimer, the term of this patent is extended or adjusted under 35 U.S.C. 154(b) by 584 days.

(21) Appl. No.: 12/321,513

(22) Filed: Jan. 21, 2009

(65) Prior Publication Data

US 2010/0183174 A1 Jul. 22, 2010

(51) Int. Cl.
*H04R 25/00* (2006.01)

(52) U.S. Cl. ..... 381/175; 381/355

(58) Field of Classification Search ..... 381/175, 381/176, 355, 356, 365, 369
See application file for complete search history.

(56) References Cited

U.S. PATENT DOCUMENTS

| | | | | |
|---|---|---|---|---|
| 7,166,910 | B2 * | 1/2007 | Minervini | 257/704 |
| 7,171,012 | B2 * | 1/2007 | Izuchi et al. | 381/174 |
| 2008/0157238 | A1 | 7/2008 | Hsiao | 257/416 |
| 2008/0164545 | A1 | 7/2008 | Hsiao | 257/416 |
| 2009/0014819 | A1 | 1/2009 | Loeffler | 257/415 |
| 2009/0016550 | A1 | 1/2009 | Qiao | 381/175 |

FOREIGN PATENT DOCUMENTS

| | | | |
|---|---|---|---|
| CN | 101296530 | A | 10/2009 |
| EP | 1722596 | A1 | 11/2006 |
| WO | WO2008-134530 | A2 | 11/2008 |

* cited by examiner

*Primary Examiner* — Hoai V Pham
(74) *Attorney, Agent, or Firm* — Harrington & Smith

(57) ABSTRACT

In one exemplary embodiment, an apparatus includes: a first substrate having an aperture adapted to receive an acoustic signal; a microphone comprising a plate connected to the first substrate and a movable member connected to the first substrate, where the microphone is adapted to transduce the received acoustic signal into an electrical signal; a second substrate connected to the first substrate; at least one wall connected to the first substrate and the second substrate such that the at least one wall, the first substrate, the second substrate and the microphone define an interior cavity; and an electrical component on the second substrate and electrically coupled to the microphone, where the electrical component is configured to generate an output based on the electrical signal.

11 Claims, 9 Drawing Sheets

MICROPHONE PACKAGE

TECHNICAL FIELD

The exemplary and non-limiting embodiments of this invention relate generally to apparatus, methods and electronic modules and, more specifically, relate to modules configured to transduce acoustic signals into electrical signals (e.g., microphones).

BACKGROUND

One design for conventional microphones is a condenser microphone. Condenser microphones, also referred to as capacitor microphones, have a diaphragm act as one plate of a capacitor. Vibrations from an acoustic signal (sound) produce changes in the distance between the two plates, thus affecting the capacitance across the plates and/or the voltage across the plates. By measuring one of these, an electrical signal corresponding to the sound can be produced. One particular type of condenser microphones is the electret condenser microphone (ECM). An ECM uses a permanently-charged material, the electret (a dielectric film that has a permanent electric charge), on the top of a back plate.

A developing technology for portable electronic devices involves the application of microelectromechanical systems (MEMS) to microphones. MEMS technology enables the construction of small mechanical components on a substrate, such as a printed circuit board (PCB). MEMS are generally comprised of components 1-100 micrometers (microns) in size (0.001-0.1 mm) and MEMS devices generally range in size from 20 micrometers (0.02 mm) to 1 mm. The standard constructs of classical physics do not always hold true at these size scales. Surface effects such as electrostatics and wetting dominate volume effects such as inertia or thermal mass due to MEMS' large surface area to volume ratio.

FIG. 1 depicts a cross section of the general architecture of a MEMS microphone 100. A diaphragm 102 is disposed in front of a plate 104 and is configured to vibrate freely in response to sound 106. A charged capacitor is formed by two parallel plates where the diaphragm 102 acts as one plate of the capacitor (i.e., the diaphragm 102 is capacitively coupled to the other parallel plate 104). The vibration of the diaphragm 102 results in a change in capacitance of the capacitor, detectable as an electrical signal from the other parallel plate 104. The diaphragm 102 and the plate 104 are held in position by one or more supports 108. As a non-limiting example, the support 108 may enclose or partially define a volume 107 (e.g., a region of air) in front of the diaphragm 102, sometimes referred to as a front volume (located between the incoming acoustic signal and the diaphragm 102, i.e., in "front" of the diaphragm 102 and the plate 104). As a non-limiting example, the support 108 may enclose or partially define a volume 109 (e.g., a region of air) behind the diaphragm 102, sometimes referred to as a back volume (located behind or in "back" of the diaphragm 102). Generally the support 108 is formed from a non-conductive support material.

It should be noted that in other designs a MEMS microphone may have a front plate instead of a back plate. The front plate would be located in "front". of the diaphragm (e.g., between the diaphragm and the incoming sound). Furthermore, in some designs the front plate or the back plate is porous, having holes through which air can penetrate the plate.

A MEMS microphone offers a number of advantages over an ECM, including advantages in manufacturability, production volume scalability and stability in varying environments, as non-limiting examples. It is often challenging to design an acoustically optimized MEMS microphone package because package design requirements are largely set by the mechanical interfaces of the device in which the MEMS microphone is to be used. For example, the design requirements may depend on how and where the MEMS microphone is integrated in the device.

Generally, there are two basic solutions for implementing a MEMS microphone package in a device: a top port package and a bottom port package. FIG. 2 illustrates a cross section of a top port package 110 for a MEMS microphone 100. The MEMS microphone 100 is disposed on a substrate, such as a PCB 112. Also disposed on the PCB 112 is an application-specific integrated circuit (ASIC) 114. The ASIC 114 generally includes one or more contacts 116 extending along the surface of the PCB 112 or through the PCB 112. These contacts 116 enable the ASIC 114 to connect with other components outside the package 110, such as a processor in the device. Furthermore, these contacts 116 allow the package 110 to be mounted on and/or connected to a larger PCB (e.g., of the device or of another component) within which the package 110 is used and located.

The package 110 also includes a wall 118. The support material from which the wall 118 is formed may be conductive or non-conductive. The wall 118 has a top aperture (opening) 120 in the top of the package 110 for reception of an acoustic signal. The wall 118, PCB 112, support 108 and diaphragm 102 define a region, referred to as a front volume 122, located between the aperture 120 and the diaphragm 102 (i.e., in "front" of the diaphragm 102). The support 108 and the PCB 112 define a region, referred to as a back volume 124, located between the diaphragm 102 and the PCB 116 (i.e., in "back" of the diaphragm 102).

As can be appreciated from FIG. 2, in a top port package 110 the front volume 122 is larger than the back volume 124, leading to undesirable acoustics, including difficulty in achieving an acceptable signal-to-noise ratio (SNR) and unwanted resonance peaks in the frequency response of the useable audio band. Thus, the top port package 110 may have a relatively poor performance level.

FIG. 3 shows a cross section of a bottom port package 130 for a MEMS microphone 100. As compared with the top port package 110 of FIG. 2, the bottom port package 130 has a bottom aperture (opening) 126 in the PCB 112 instead of the wall 118. This leads to reception of an acoustic signal from the bottom of the package 130. Furthermore, note that the diaphragm 102 and plate 104 are reversed such that the plate 104 remains behind the diaphragm 102. As noted above, in other designs a front plate, located in front of the diaphragm 102, may be used.

In the bottom port package 130, the back volume 124 is larger than the front volume 122 leading to improved acoustics (acoustical properties) as compared to the top port package 110. Thus, from an acoustic design perspective, the bottom port package 130 of FIG. 3 is more optimal than the top port package 110 of FIG. 2.

Four alternatives over the basic top port package design 110 of FIG. 2 are discussed below in reference to FIGS. 4-7. FIG. 4 illustrates a cross section of a first alternative top port package 150. The substrate 152 upon which the other components are assembled is designed to have an acoustical cavity 154 connected to the back of the MEMS microphone element 100 by an aperture 156. This effectively enlarges the back cavity 124 and improves the acoustic properties. However, this package 160 is more difficult and more expensive to mass manufacture. Furthermore, and particularly in reference to the bottom port package 130 of FIG. 3, the top port package 150 of FIG. 4 still has a relatively large front volume (front cavity 122) and a comparatively small back volume (back cavity 124).

FIG. 5 illustrates a cross section of a second alternative top port package 160. The top aperture 120 leads to an acoustic channel 162 that extends into an acoustic cavity 164 in the substrate 165. The acoustic cavity 164 connects to an underside of a combined MEMS-ASIC component 166. An interior cavity 167 on the other side of the combined MEMS-ASIC component acts as the back cavity, while the acoustic cavity 164 acts as the front cavity. The second alternative top port package 160 is very difficult to manufacture and has unacceptable acoustical performance.

FIG. 6 illustrates a cross section of a third alternative top port package 170. The top aperture 120 leads to a front cavity 122 that is defined by sealing material 172 and the diaphragm 102. An opening 174 in the support 108 provides an enlarged back cavity 124. While having improved acoustical performance, the third alternative top port package 170 is mechanically unreliable (e.g., fragile and/or susceptible to mechanical forces) and difficult to mass manufacture. In particular, the MEMS microphone 100 and its mechanical connection (adhesion) to the substrate 112 are at risk from mechanical impacts, such as dropping of the package 170. Furthermore, the sealing of the MEMS microphone 100 to the lid is difficult since the sealing acts as a spring, pushing the lid upwards while it should be affixed (e.g., soldered or glued) to the substrate 112.

FIG. 7 illustrates a cross section of a fourth alternative top port package 180. The fourth alternative package 180 resembles an inversion of the bottom port package 130 of FIG. 3 (i.e., turning the package 130 of FIG. 3 upside down). The fourth alternative package 180 includes a top substrate 182 having a top aperture 120 leading to the front cavity 122. The other side of the microphone 190, in conjunction with the wall 118, the support 108, the top substrate 182 and a bottom substrate 184, defines the back cavity 124. Note, however, that it is assumed that the bottom substrate 184 of the package 180 will be mounted on or connected to a larger substrate (e.g., a PCB) of the device. As such, a number of connections (e.g., the five connections 186) are provided to enable the ASIC 114 to communicate with other components of the device. As a non-limiting example, the connections 186 may comprise a series of stacked vias. While providing improved acoustical performance, the fourth alternative top port package 180 is mechanically unreliable (e.g., fragile and/or susceptible to mechanical forces) and difficult to mass manufacture, particularly due to the required connections. Furthermore, the connections 186 are space-consuming and unreliable, and the ASIC must reside on the top substrate 182 or else it would interfere with the membrane of the microphone or significantly increase the front volume (due to its increased height).

SUMMARY

The below summary section is intended to be merely exemplary and non-limiting.

In one exemplary embodiment, an apparatus comprising: a first substrate comprising an aperture adapted to receive an acoustic signal; a microphone comprising a plate connected to the first substrate and a movable member connected to the first substrate, where the microphone is adapted to transduce the received acoustic signal into an electrical signal; a second substrate connected to the first substrate; at least one wall connected to the first substrate and the second substrate such that the at least one wall, the first substrate, the second substrate and the microphone define an interior cavity; and an electrical component on the second substrate and electrically coupled to the microphone, where the electrical component is configured to generate an output based on the electrical signal.

In another exemplary embodiment, a method comprising: installing an integrated circuit on a first substrate; installing a microelectromechanical system (MEMS) microphone on a second substrate having an aperture, the MEMS microphone comprising a plate and a movable member, where the MEMS microphone is adapted to transduce an acoustic signal received via the aperture into an electrical signal; and installing the second substrate in a spaced-apart relationship with the first substrate thereby forming a cavity between the second substrate and the first substrate.

BRIEF DESCRIPTION OF THE DRAWINGS

The foregoing and other aspects of exemplary embodiments of this invention are made more evident in the following Detailed Description, when read in conjunction with the attached Drawing Figures, wherein.

DETAILED DESCRIPTION

The exemplary embodiments of the invention address the above-noted problems by providing a top port microphone package (e.g., a MEMS microphone package) having improved acoustical properties and sound structural support as well as stable and easy manufacturability.

Figure 8:
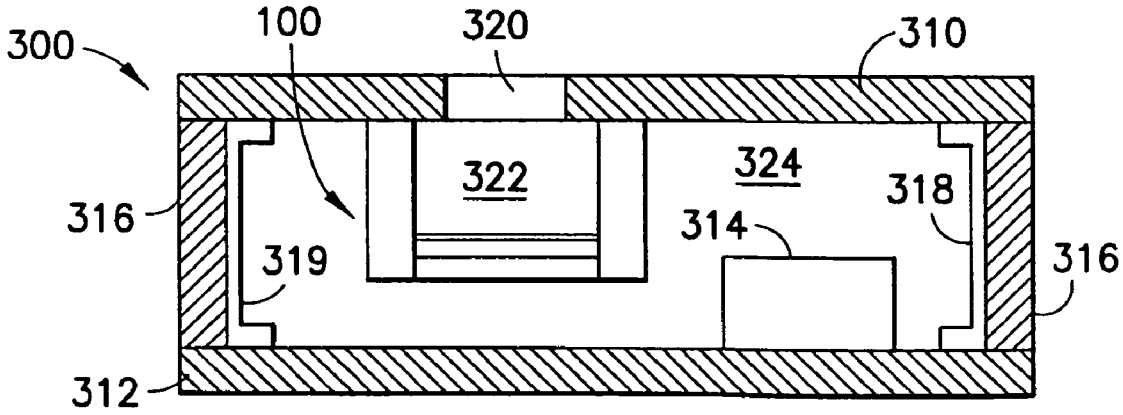
FIG. 8 shows a cross section of an exemplary MEMS microphone package in accordance with the exemplary embodiments of the invention.

FIG. 8 shows a cross section of an exemplary MEMS microphone package 300 in accordance with the exemplary embodiments of the invention. The package 300 includes a MEMS microphone 100 connected to a top substrate 310. The top substrate 310 has an aperture (opening) 320 through which an acoustic signal (sound) is received by the MEMS microphone 100. The top substrate 310 is connected to a bottom substrate 312 via one or more support structures 316 (e.g., one or more walls). At least one electronic component, such as an ASIC 314, is located on the bottom substrate 312. The ASIC 314 generally includes one or more contacts (not shown) extending along the surface of the bottom substrate 312 or through the bottom substrate 312. These contacts enable the ASIC 314 to connect with other components outside the package 300, such as a processor in the device: Furthermore, these contacts allow the package 3000 to be mounted on and/or connected to the device or another component within which the package 300 is used and located. As a non-limiting example, the bottom substrate 312 (e.g., an ASIC subtrate) may include solder joints for connecting to another PCB. As non-limiting examples, one or both of the top substrate 310 and the bottom substrate 312 may comprise a PCB.

The MEMS microphone 100 (e.g., the plate 104 of the MEMS microphone 100) is coupled to the ASIC 314 via at least one internal contact 318,319. In some exemplary embodiments, two contacts 318, 319 are used. In further exemplary embodiments, a first contact 318 carries the positive MEMS element signal (+) and a second contact carries the negative MEMS element signal (−). In some exemplary embodiments, only one contact (e.g., the first contact 318) is used to carry the positive MEMS element signal (+), with a metal case of the package being used to carry the negative MEMS element signal (−). In further exemplary embodiments, two contacts 318, 319 are used, with the first contact 318 acting to bias the MEMS element (the MEMS microphone 100) and the second contact 319 acting as ground.

The support structure 316, top substrate 310, bottom substrate 312 and MEMS microphone 100 (e.g., the support(s) 108 and the diaphragm 102) define an interior cavity 324 of the package 300. This interior cavity 324 serves as the back cavity of the package 300. Note that another cavity 322, partially defined by the front of the MEMS microphone 100 (e.g., the support(s) 108 and the diaphragm 102), serves as the front cavity of the package 300.

Figure 1:
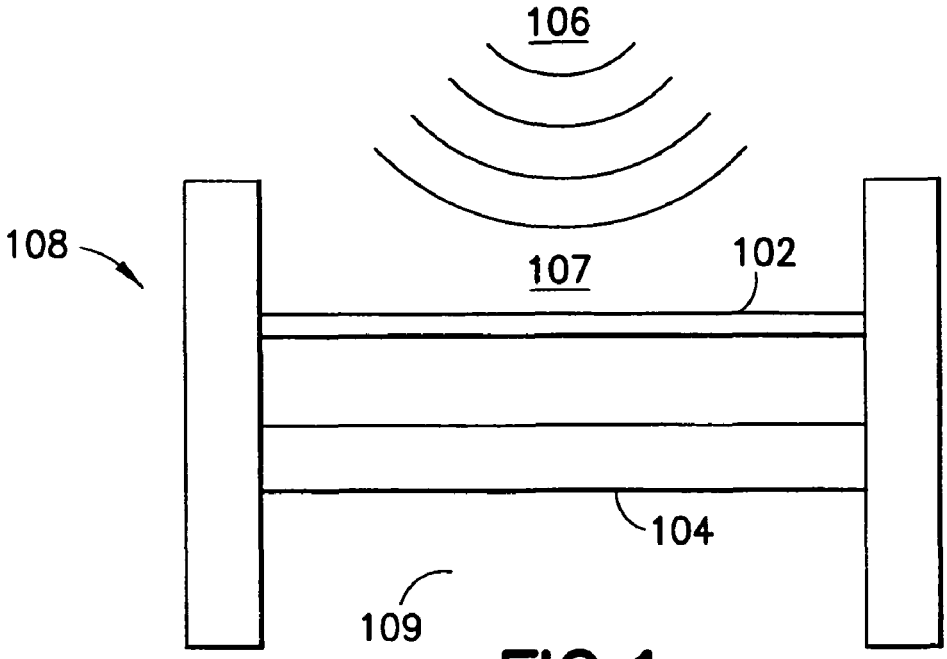
FIG. 1 PRIOR ART
FIG. 1 depicts a cross section of the general architecture of a MEMS microphone.
Figure 2:
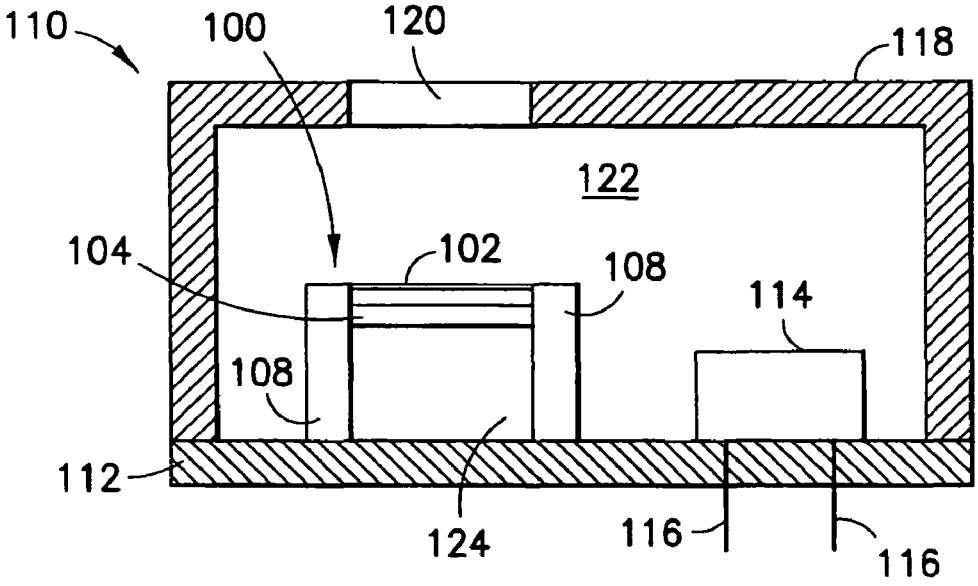
FIG. 2 PRIOR ART
FIG. 2 illustrates a cross section of a top port package for a MEMS microphone.
Figure 3:
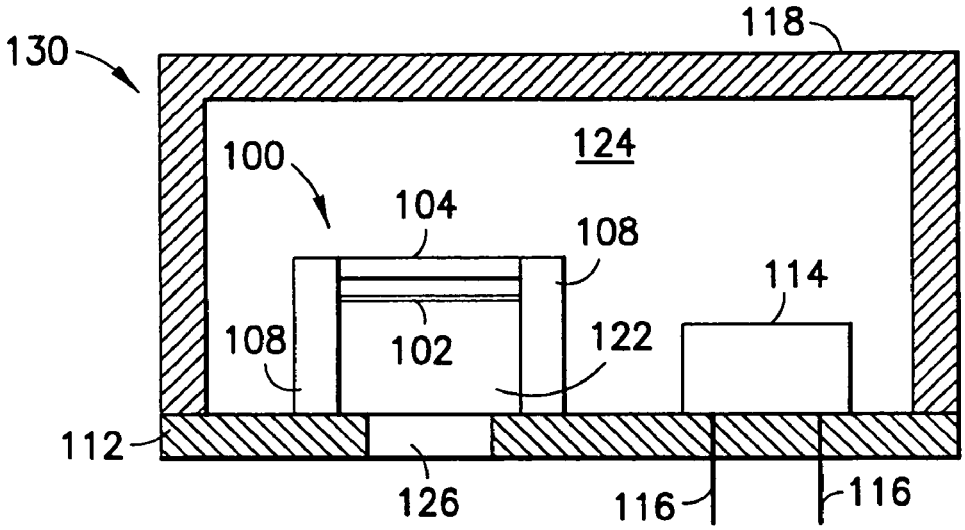
FIG.3 PRIOR ART
FIG. 3 shows a cross section of a bottom port package for a MEMS microphone.
Figure 4:
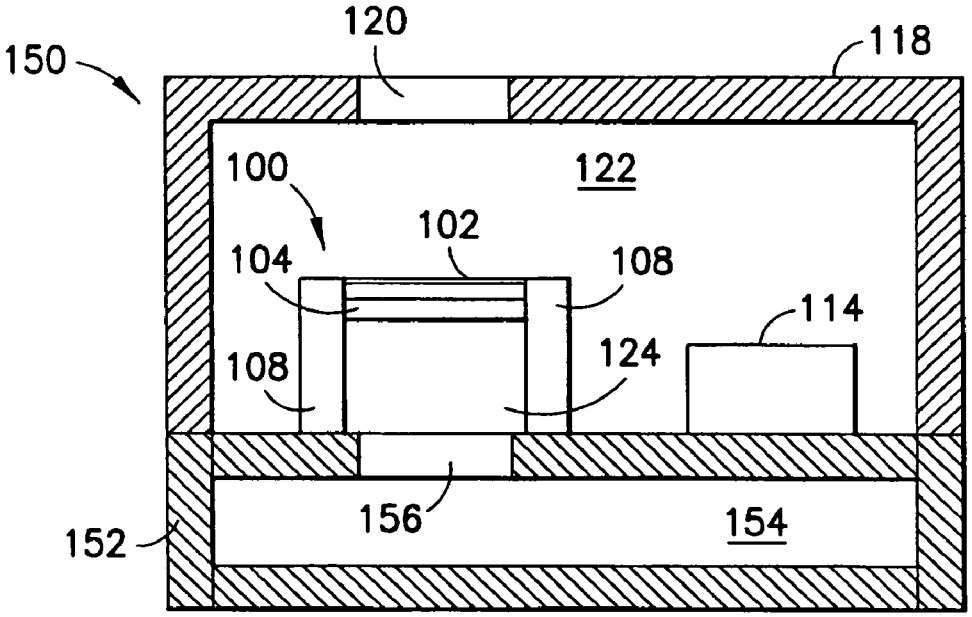
FIG.4 PRIOR ART
FIG. 4 illustrates a cross section of a first alternative top port package.
Figure 5:
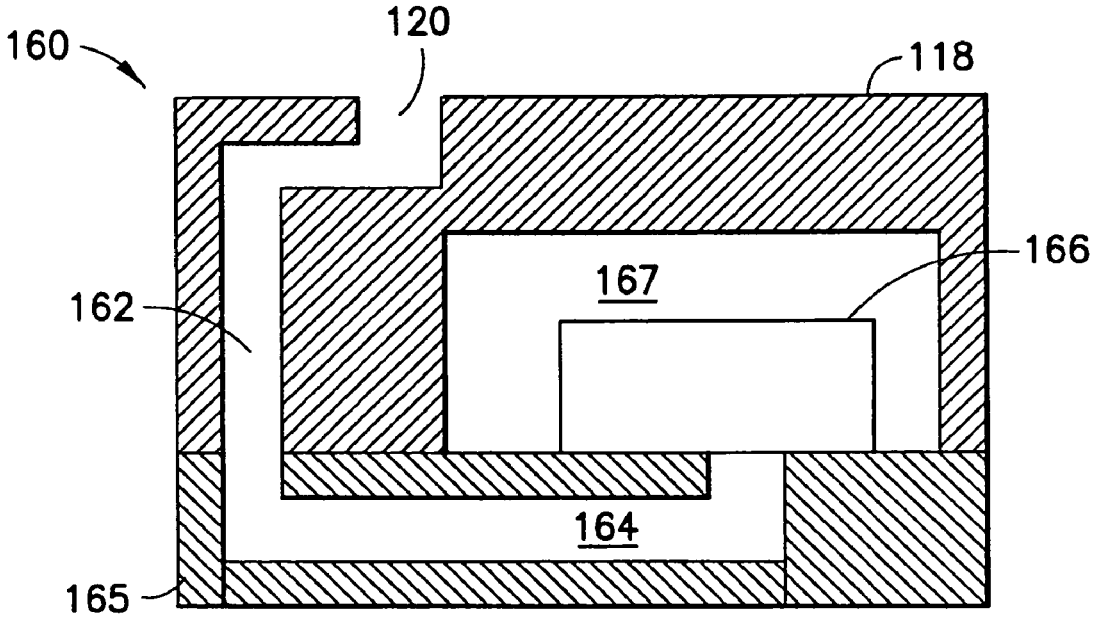
FIG.5 PRIOR ART
FIG. 5 illustrates a cross section of a second alternative top port package.
Figure 6:
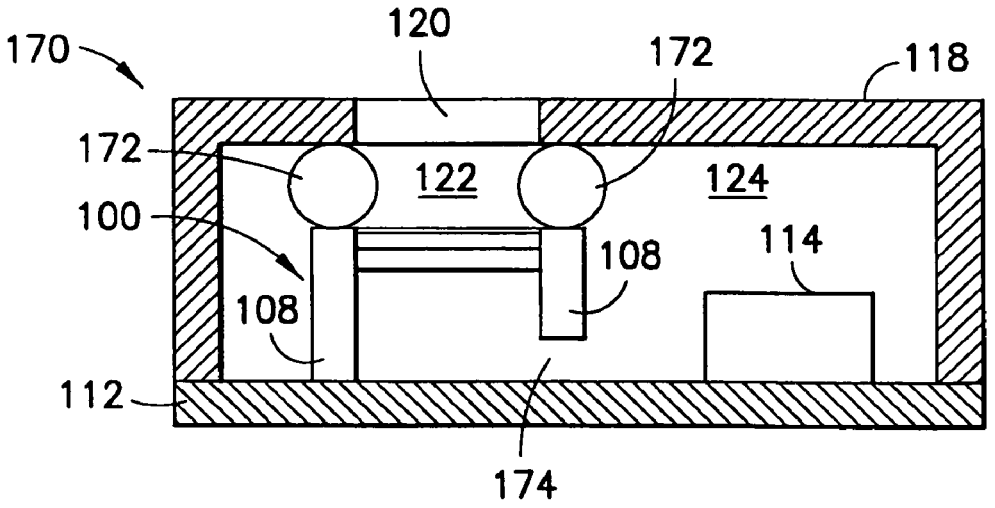
FIG.6 PRIOR ART
FIG. 6 illustrates a cross section of a third alternative top port package.
Figure 7:
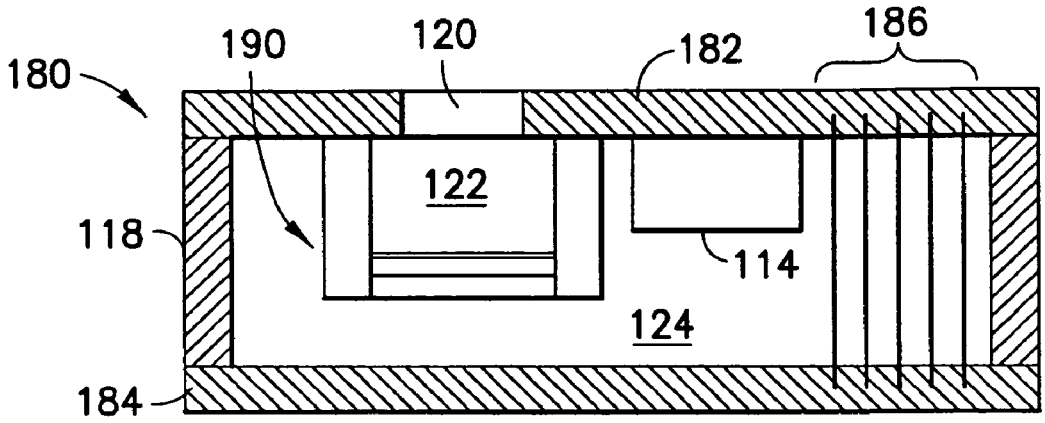
FIG.7 PRIOR ART
FIG. 7 illustrates a cross section of a fourth alternative top port package.

The exemplary MEMS microphone package 300 shown in FIG. 8 has a number of advantages. The back cavity (interior cavity 324) is larger than the front cavity (the other cavity 322), thus providing desirable acoustic properties, such as an optimized SNR and an optimized flat frequency response, as non-limiting examples. Furthermore, since the ASIC 314 is on the bottom substrate 312 (i.e., the same substrate that is used for connecting with other components, modules or PCBs) only one or two internal contacts 318, 319 are needed, leading to a simpler design that is more structurally sound than that of the package 180 shown in FIG. 7. In addition, the implementation of the exemplary package 300 is comparatively easy, particularly as existing production lines (e.g., for MEMS top port microphones) can be used. In some exemplary embodiments, these advantages are provided by usage of the top substrate 310, locating the ASIC 314 on the bottom substrate 314 (e.g., the same substrate that is used for connecting with other components, modules or PCBs or a different substrate than that to which the MEMS microphone is attached) and/or allowing for usage of conventional connections from the package (i.e., from the bottom substrate 314).

In other exemplary embodiments, a front plate may be used instead of a plate 104. In such a case, the front plate would be located in front of the diaphragm 102 (i.e., between the diaphragm 102 and the source of the sound). The front plate would act as the second plate of the capacitor in a manner similar to that of the plate 104.

Figure 9:
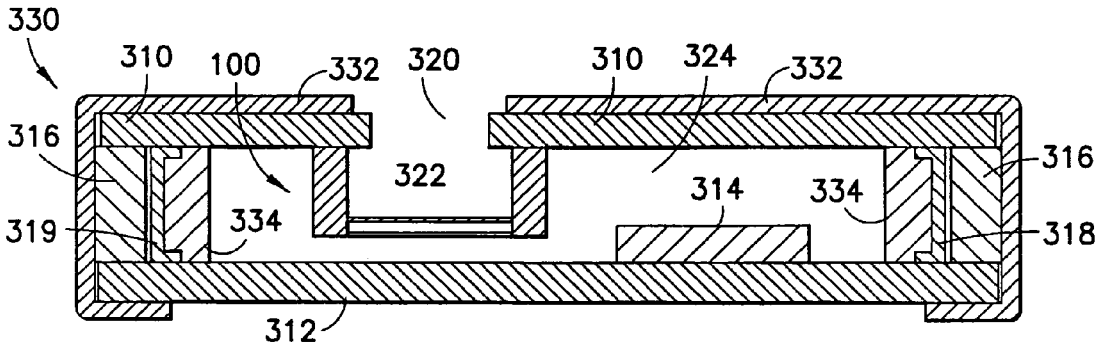
FIG. 9 shows a cross section of another exemplary MEMS microphone package in accordance with the exemplary embodiments of the invention.

FIG. 9 shows a cross section of another exemplary MEMS microphone package 330 in accordance with the exemplary embodiments of the invention. The exemplary package 330 of FIG. 9 is similar to that of FIG. 8 (package 300) with a few additional components identified. The exemplary MEMS microphone package 330 of FIG. 9 has a metal case 332 surrounding the other components. The metal case 332 does not entirely encase the other components, as evident by the aperture 320 and the exposure of the bottom substrate 312. The package 330 also includes another internal support structure 334. In some exemplary embodiments, the internal contacts 318, 319 may be formed on or connected to the other internal support structure 334.

Figure 10:
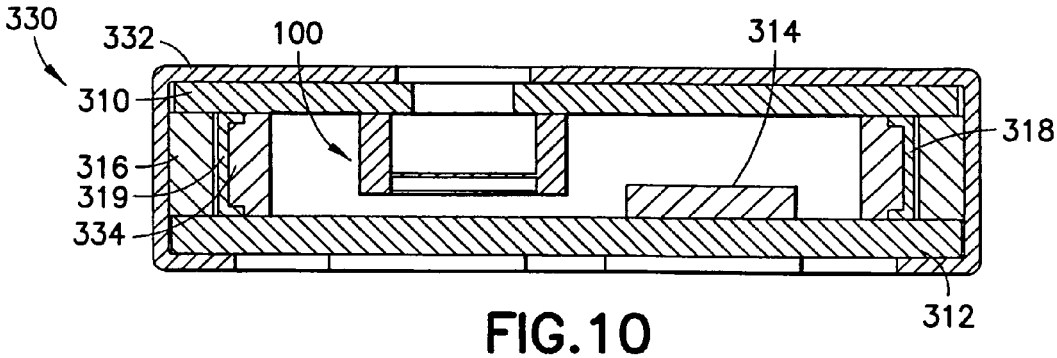
FIG. 10 shows another cross section of the exemplary MEMS microphone package of FIG. 9.
Figure 11:
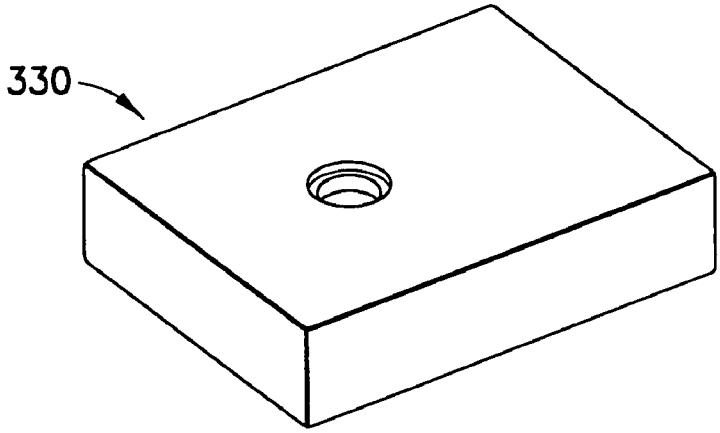
FIG. 11 shows a perspective view of the exemplary MEMS microphone package of FIG. 9.
Figure 12:
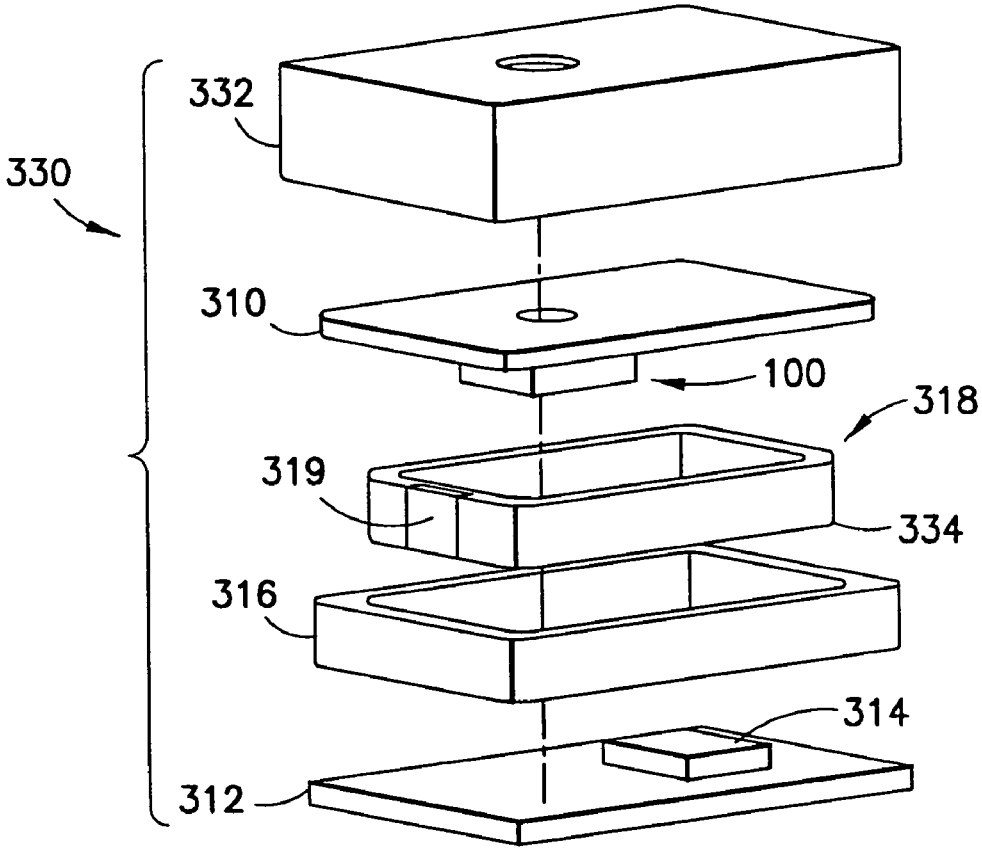
FIG. 12 shows an exploded view of the exemplary MEMS microphone package of FIG. 9.

FIG. 10 shows another cross section of the exemplary MEMS microphone package 330 of FIG. 9. FIG. 11 shows a perspective view of the exemplary MEMS microphone package 330 of FIG. 9. FIG. 12 shows an exploded view of the exemplary MEMS microphone package 330 of FIG. 9. The MEMS microphone package 330 of FIGS. 9-12 operates in accordance with the exemplary embodiments of the invention, as described in further detail herein.

Figure 13:
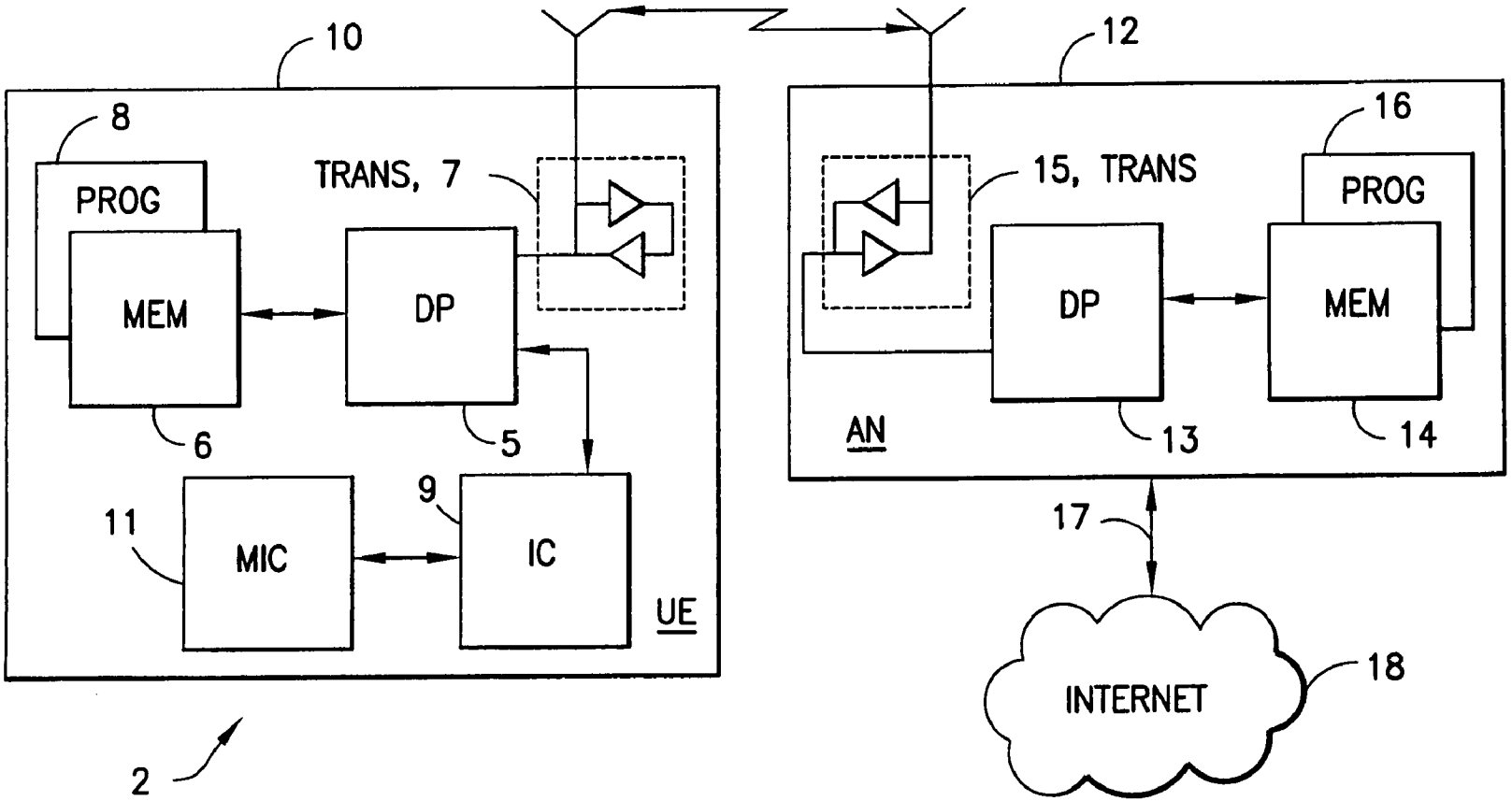
FIG. 13 shows a simplified block diagram of various exemplary electronic devices that are suitable for use in practicing the exemplary embodiments of this invention.

Reference is made to FIG. 13 for illustrating a simplified block diagram of various electronic devices that are suitable for use in practicing the exemplary embodiments of this invention. In FIG. 13, a wireless network 2 is adapted for communication with a user equipment (UE) 10 via an access node (AN) 12. The UE 10 includes a data processor (DP) 5, a memory (MEM) 6 coupled to the DP 5, and a suitable RF transceiver (TRANS) 7 (having a transmitter (TX) and a receiver (RX)) coupled to the DP 5. The MEM 6 stores a program (PROG) 8. The TRANS 7 is for bidirectional wireless communications with the AN 12. Note that the TRANS 7 has at least one antenna to facilitate communication. The UE 10 also includes at least one electrical component, such as an integrated circuit (IC) 9, in accordance with the exemplary embodiments of the invention. The IC 9 is coupled to a microphone (MIC) 11. As non-limiting examples, the MIC 11 may comprise a MEMS microphone or an ECM microphone.

The AN 12 includes a data processor (DP) 13, a memory (MEM) 14 coupled to the DP 13, and a suitable RF transceiver (TRANS) 15 (having a transmitter (TX) and a receiver (RX)) coupled to the DP 13. The MEM 14 stores a program (PROG) 16. The TRANS 15 is for wireless communication with the UE 10. Note that the TRANS 15 has at least one antenna to facilitate communication. The AN 12 is coupled via a data path 17 to one or more external networks or systems, such as the internet 18, for example.

At least one of the PROGs 8, 16 is assumed to include program instructions that, when executed by the associated DP 5, 13, enable the respective electronic device to operate in accordance with the exemplary embodiments of this invention, as discussed herein.

In general, the various exemplary embodiments of the UE 10 can include, but are not limited to, mobile nodes, mobile stations, mobile phones, cellular phones, personal digital assistants (PDAs) having wireless communication capabilities, mobile routers, relay stations, relay nodes, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

In general, the various exemplary embodiments of the AN 12 can include, but are not limited to, wireless access nodes, base stations, relay nodes, relay stations, routers and mobile routers.

The exemplary embodiments of this invention may be implemented by hardware, or by a combination of software and hardware. In some exemplary embodiments, the MIC 11 may comprise the IC 9. In other exemplary embodiments, the MIC 11 may comprise a microphone module (e.g., a MEMS microphone module) incorporating the IC 9. In further exemplary embodiments, instead of or in addition to the UE 12, the AN 12 may comprise the IC and/or the MIC.

The MEMs 6, 14 may be of any type suitable to the local technical environment and may be implemented using any suitable data storage technology, such as semiconductor-based memory devices, flash memory, magnetic memory devices and systems, optical memory devices and systems, fixed memory and removable memory, as non-limiting examples. The DPs 5, 13 may be of any type suitable to the local technical environment, and may include one or more of general purpose computers, special purpose computers, microprocessors, digital signal processors (DSPs) and processors based on a multi-core processor architecture, as non-limiting examples.

Figure 14:
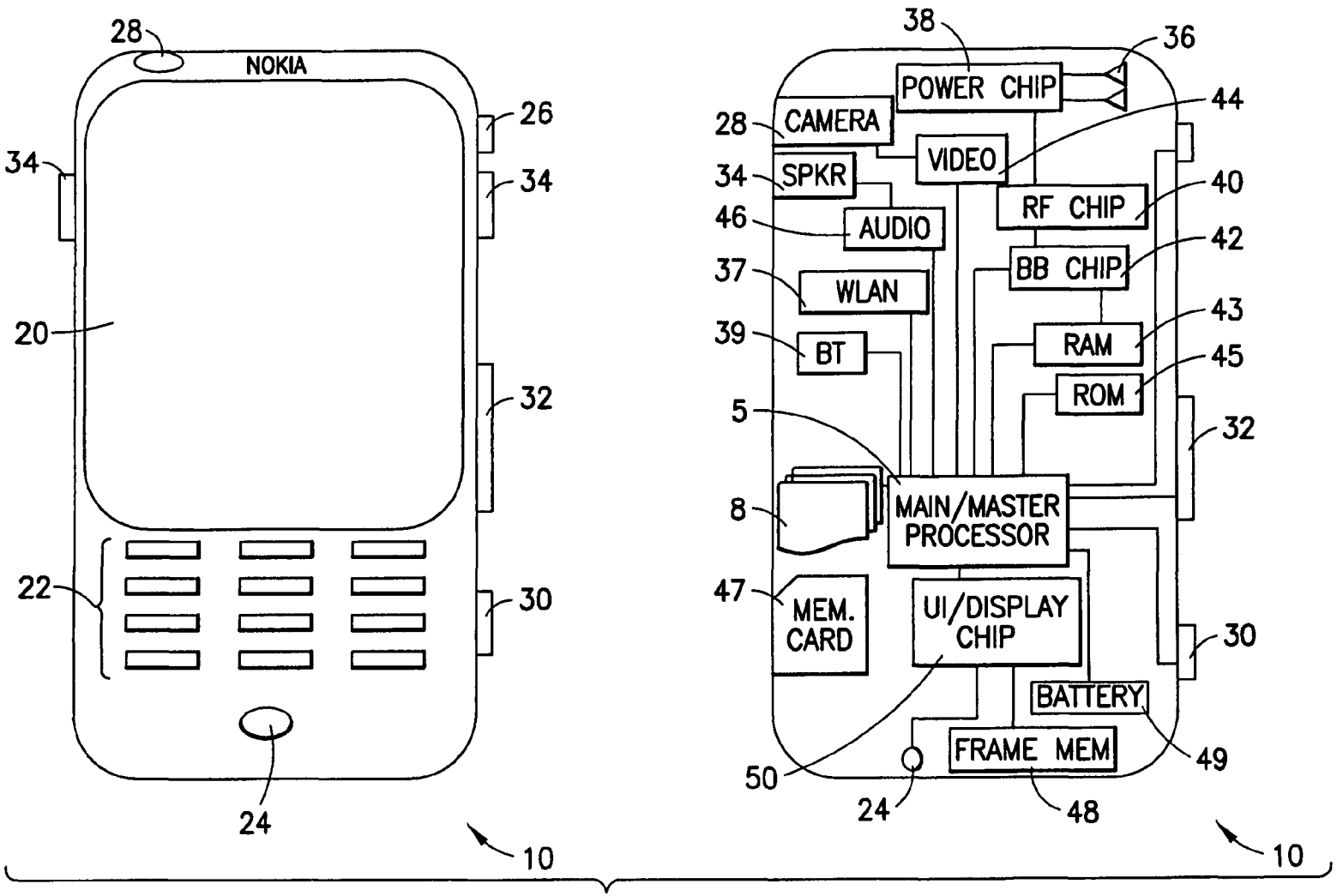
FIG. 14 shows a more particularized block diagram of an exemplary user equipment such as that shown in FIG. 13.

FIG. 14 illustrates further detail of an exemplary UE 10 in both plan view (left) and sectional view (right). Exemplary embodiments of the invention may be embodied in one or more combinations that include one or more function-specific components, such as those shown in FIG. 14. As shown in FIG. 14, the UE 10 includes a graphical display interface 20, a user interface 22 comprising a keypad, a microphone 24 and speaker(s) 34. In further exemplary embodiments, the UE 10 may also encompass touch-screen technology at the graphical display interface 20 and/or voice-recognition technology for audio signals received at the microphone 24. A power actuator 26 controls the UE 10 being turned on and/or off by the user. The UE 10 may include a camera 28, which is shown as forward facing (e.g., for video calls) but may alternatively or additionally be rearward facing (e.g., for capturing images and video for local storage). The camera 28 may be controlled by a shutter actuator 30 and optionally by a zoom actuator 30, which may alternatively function as a volume adjustment for the speaker(s) 34 when the camera 28 is not in an active mode.

Within the sectional view of FIG. 14 are seen multiple transmit/receive antennas 36 that are typically used for wireless communication (e.g., cellular communication). The antennas 36 may be multi-band for use with other radios in the UE. The operable ground plane for the antennas 36 is shown by shading as spanning the entire space enclosed by the UE housing, though in some embodiments the ground plane may be limited to a smaller area, such as disposed on a printed wiring board on which a power chip 38 is formed. The power chip 38 controls power amplification on the channels being transmitted on and/or across the antennas that transmit simultaneously, where spatial diversity is used, and amplifies received signals. The power chip 38 outputs the amplified received signal to the radio frequency (RF) chip 40, which demodulates and downconverts the signal for baseband processing. The baseband (BB) chip 42 detects the signal, which is then converted to a bit-stream and finally decoded. Similar processing occurs in reverse for signals generated in the UE 10 and transmitted from it.

Signals to and from the camera 28 pass through an image/video processor (video) 44, which encodes and decodes the image data (e.g., image frames). A separate audio processor 46 may also be present to control signals to and from the speakers (spkr) 34 and the microphone 24. The graphical display interface 20 is refreshed from a frame memory (frame mem) 48 as controlled by a user interface/display chip 50, which may process signals to and from the display interface 20 and/or additionally process user inputs from the keypad 22 and elsewhere.

Certain exemplary embodiments of the UE 10 may also include one or more secondary radios such as a wireless local area network radio (WLAN) 37 and/or a Bluetooth® radio (BT) 39, which may incorporate one or more on-chip antennas or be coupled to one or more off-chip antennas. Throughout the UE 10 are various memories, such as a random access memory (RAM) 43, a read only memory (ROM) 45, and, in some exemplary embodiments, a removable memory such as the illustrated memory card 47. In some exemplary embodiments, the various programs 8 are stored on the memory card 47. The components within the UE 10 may be powered by a portable power supply such as a battery 49.

The aforesaid processors 38, 40, 42, 44, 46, 50, if embodied as separate entities in the UE 10 or the eNB 12, may operate in a master-slave relationship with respect to the main/master processor 5, 13. Exemplary embodiments of this invention may be most relevant to the user interface/display chip 50, though it is noted that other exemplary embodiments need not be disposed in such devices or components, but may be disposed across various chips and/or memories as shown, or disposed within one or more other processors that combine one or more of the functions described above with respect to FIG. 14. Any or all of these various processors of FIG. 14 may access one or more of the various memories, which may be on-chip with the processor or separate therefrom. Similar function-specific components that are directed toward communications over a network broader than a piconet (e.g., components 36, 38, 40, 42-45 and 47) may also be disposed in exemplary embodiments of the access node 12, which, in some exemplary embodiments, may include an array of tower-mounted antennas rather than the antennas 36 shown in FIG. 14.

Note that the various processors and/or chips (e.g., 38, 40, 42, etc.) described above may be combined into a fewer number of such processors and/or chips and, in a most compact case, may be embodied physically within a single processor or chip.

While described above in reference to memories, these components may generally be seen to correspond to storage devices, storage circuits, storage components and/or storage blocks. In some exemplary embodiments, these components may comprise one or more computer-readable mediums, one or more computer-readable memories and/or one or more program storage devices.

While described above in reference to data processors, these components may generally be seen to correspond to processors, data processors, processing devices, processing components, processing blocks, circuits, circuit devices, circuit components, circuit blocks, integrated circuits and/or chips (e.g., chips comprising one or more circuits or integrated circuits).

Below are provided further descriptions of various non-limiting, exemplary embodiments. The below-described exemplary embodiments are separately numbered for clarity and identification. This numbering should not be construed as wholly separating the below descriptions since various aspects of one or more exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

(1) In one exemplary embodiment, an apparatus comprising: a first substrate comprising an aperture adapted to receive an acoustic signal; a microphone comprising a plate connected to the first substrate and a movable member connected to the first substrate, where the microphone is adapted to transduce the received acoustic signal into an electrical signal; a second substrate connected to the first substrate; at least one wall connected to the first substrate and the second substrate such that the at least one wall, the first substrate, the second substrate arid the microphone define an interior cavity; and an electrical component on the second substrate and electrically coupled to the microphone, where the electrical component is configured to generate an output based on the electrical signal.

An apparatus as above, further comprising at least one internal contact connected to the first substrate and the second substrate, where the at least one internal contact is configured to electrically couple the electrical component to the microphone. An apparatus as in any above, where the movable member comprises a diaphragm or a membrane. An apparatus as in any above, where the first substrate comprises a printed circuit board. An apparatus as in any above, where the second substrate comprises a printed circuit board. An apparatus as in any above, further comprising a case connected to the first substrate and the second substrate. An apparatus as in any above, where the case comprises a metal case.

An apparatus as in any above, where the electrical component comprises an integrated circuit component. An apparatus as in any above, where the microphone comprises a microelectromechanical system microphone. An apparatus as in any above, where the apparatus comprises a microelectromechanical system microphone module. An apparatus as in any above, where the apparatus comprises a microelectromechanical system microphone module embodied within a mobile device. An apparatus as in any above, where the apparatus comprises a top port microelectromechanical system microphone module embodied within a mobile phone.

Figure 15:
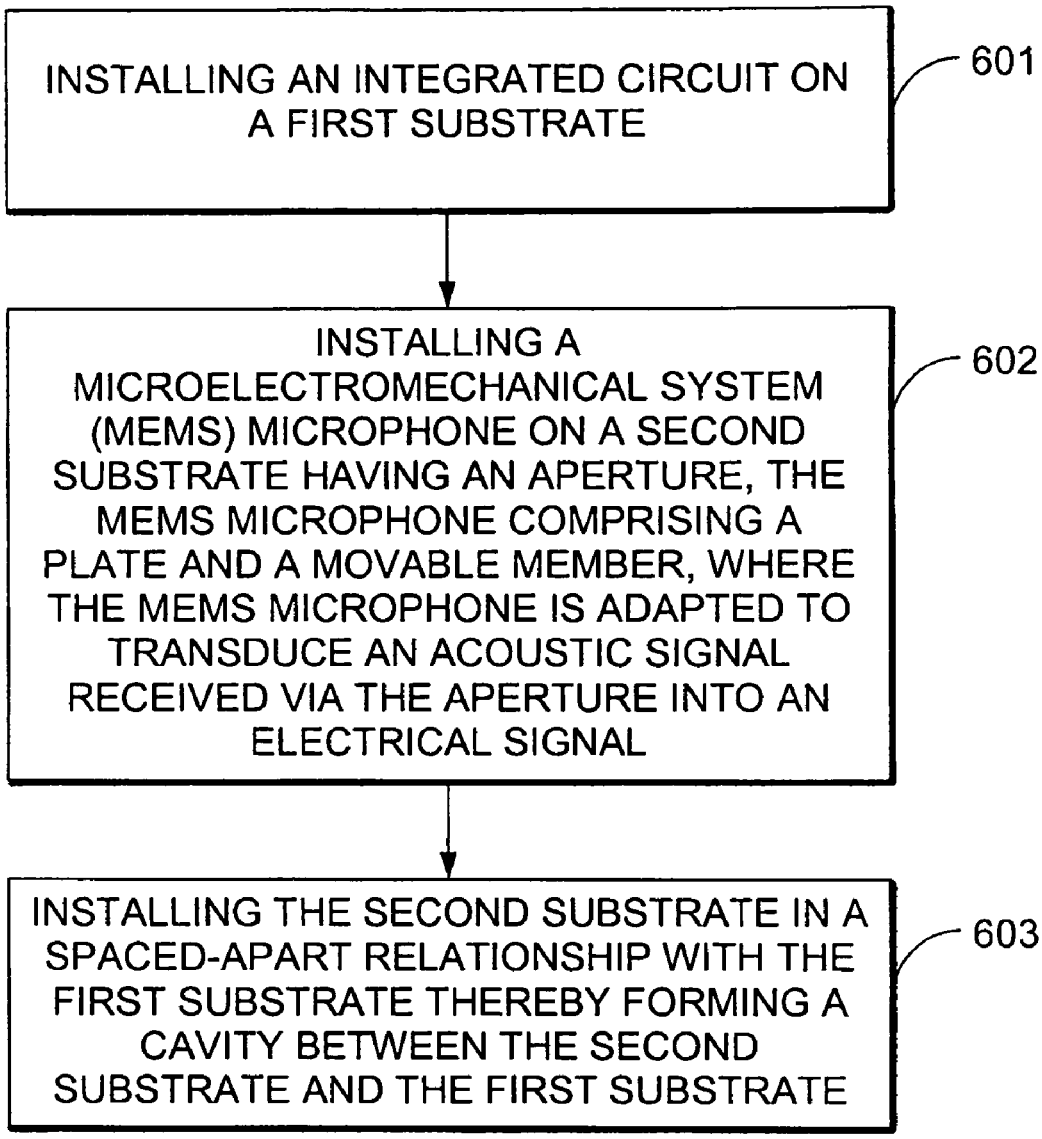
FIG. 15 depicts a flowchart illustrating one non-limiting example of a method for practicing the exemplary embodiments of this invention.

(2) In another exemplary embodiment, and as illustrated in FIG. 15, a method comprising: installing an integrated circuit on a first substrate (601); installing a microelectromechanical system (MEMS) microphone on a second substrate having an aperture, the MEMS microphone comprising a plate and a movable member, where the MEMS microphone is adapted to transduce an acoustic signal received via the aperture into an electrical signal (602); and installing the second substrate in a spaced-apart relationship with the first substrate thereby forming a cavity between the second substrate and the first substrate (603).

A method as above, further comprising: installing at least one wall connected to the first substrate and the second substrate such that the at least one wall, the first substrate, the second substrate and the MEMS microphone define an interior cavity, where the at least one wall is adapted to maintain the spaced-apart relationship of the first substrate and the second substrate, where the at least one wall, the first substrate, the second substrate, the integrated circuit and the MEMS microphone comprise a microphone module. A method as in the previous, further comprising: installing the microphone module in an electronic device by attaching the first substrate of the microphone module to another substrate.

The blocks depicted in FIG. 15 may also be considered to correspond to one or more functions and/or operations that are performed by one or more components, apparatus, processors, computer programs, circuits, integrated circuits, application-specific integrated circuits (ASICs), chips and/or function blocks. Any and/or all of the above may be implemented in any practicable arrangement or solution that enables operation in accordance with the exemplary embodiments of the invention.

Furthermore, the arrangement of the blocks shown in FIG. 15 should be considered merely exemplary and non-limiting. It should be appreciated that the blocks depicted in FIG. 15 may correspond to one or more functions and/or operations that may be performed in any order (e.g., any practicable, suitable and/or feasible order) and/or concurrently (e.g., as practicable, suitable and/or feasible) so as to implement one or more of the exemplary embodiments of the invention. In addition, one or more additional steps, functions and/or operations may be utilized in conjunction with those illustrated in FIG. 15 so as to implement one or more further exemplary embodiments of the invention, such as those described in further detail herein.

That is, the non-limiting, exemplary embodiments of the invention shown in FIG. 15 may be implemented, practiced or utilized in conjunction with one or more further aspects in any combination (e.g., any combination that is practicable, suitable and/or feasible) and are not limited only to the blocks, steps, functions and/or operations illustrated in FIG. 15.

An integrated circuit (also known as IC, microcircuit, microchip, silicon chip, or chip) is a miniaturized electronic circuit (mainly comprised of semiconductor devices, as well as passive components) that is manufactured in the surface of a thin substrate (e.g., a substrate of semiconductor material).

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein, two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical region (both visible and invisible), as several non-limiting and non-exhaustive examples.

While the exemplary embodiments have been described above in the context of a MEMS microphone package, it should be appreciated that the exemplary embodiments of this invention are not limited for use with only this one particular type of package/component, and that they may be used to advantage in other electronic packages/components. As a non-limiting example, aspects of the exemplary embodiments of the invention may be utilized in conjunction with a speaker package, such as a MEMS speaker package, for example. In such an exemplary component, an acoustic signal (sound) may be transmitted via the top hole of the package.

In general, the various exemplary embodiments may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controllers, other computing devices and/or some combination thereof.

The exemplary embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the invention. However, various modifications and adaptations may become apparent to those skilled in the relevant arts in view of the foregoing description, when read in conjunction with the accompanying drawings and the appended claims. As non-limiting examples, the components and their arrangement in FIGS. 8-14 are merely exemplary. One of ordinary skill in the art will appreciate that different arrangements are possible and that additional and/or different components may be utilized. Relatedly, one of ordinary skill in the art will appreciate the various techniques that are available for forming, creating and/or producing the structures described herein. As non-limiting examples, various techniques regarding etching and/or deposition may be utilized in said production. However, all such and similar modifications of the teachings of this invention will still fall within the scope of the non-limiting and exemplary embodiments of this invention.

Furthermore, some of the features of the preferred embodiments of this invention could be used to advantage without the corresponding use of other features. As such, the foregoing description should be considered as merely illustrative of the principles, teachings and exemplary embodiments of this invention, and not in limitation thereof.

What is claimed is:

1. An apparatus comprising:

a first substrate comprising an aperture adapted to receive an acoustic signal;

a microphone comprising a plate connected to the first substrate and a movable member connected to the first substrate, where the microphone is adapted to transduce the received acoustic signal into an electrical signal;

a second substrate connected to the first substrate;

at least one wall connected to the first substrate and the second substrate such that the at least one wall, the first substrate, the second substrate and the microphone define an interior cavity;

an electrical component on the second substrate and electrically coupled to the microphone, where the electrical component is configured to generate an output based on the electrical signal; and at least one internal contact connected to the first substrate and the second substrate, where the at least one internal contact is configured to electrically couple the electrical component to the microphone.

2. An apparatus as in claim 1, where the movable member comprises a diaphragm or a membrane.

3. An apparatus as in claim 1, where the first substrate comprises a printed circuit board.

4. An apparatus as in claim 1, where the second substrate comprises a printed circuit board.

5. An apparatus as in claim 1, further comprising a case connected to the first substrate and the second substrate.

6. An apparatus as in claim 5, where the case comprises a metal case.

7. An apparatus as in claim 1, where the electrical component comprises an integrated circuit component.

8. An apparatus as in claim 1, where the microphone comprises a microelectromechanical system microphone.

9. An apparatus as in claim 1, where the apparatus comprises a microelectromechanical system microphone module.

10. An apparatus as in claim 1, where the apparatus comprises a microelectromechanical system microphone module embodied within a mobile device.

11. An apparatus as in claim 1, where the apparatus comprises a top port microelectromechanical system microphone module embodied within a mobile phone.

* * * * *